US006857863B1

(12) United States Patent
Modrzejewski et al.

(10) Patent No.: US 6,857,863 B1
(45) Date of Patent: Feb. 22, 2005

(54) POWER STEERING PUMP

(75) Inventors: Brian S. M. Modrzejewski, Livonia, MI (US); David R. Hartman, Brighton, MI (US); Brandon W. Bailey, Dearborn, MI (US); Michael D. Strickler, Whitmore Lake, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/738,054

(22) Filed: Dec. 18, 2003

(51) Int. Cl.[7] ..... F03C 2/00
(52) U.S. Cl. ..... 418/133; 418/259; 418/268
(58) Field of Search ..... 418/133, 259, 418/266, 268, 82

(56) References Cited

U.S. PATENT DOCUMENTS 1,914,091 A 6/1933 Hamilton et al.
2,103,180 A 12/1937 Rice
2,312,886 A * 3/1943 Ellinwood ..... 418/266
2,378,390 A 6/1945 Bertea
3,207,077 A * 9/1965 Zeigler et al. ..... 417/300
3,320,897 A 5/1967 Eickmann
3,463,052 A 8/1969 Matson
4,424,014 A 1/1984 Anderson
4,728,272 A 3/1988 Simonsen
4,913,636 A * 4/1990 Niemiec ..... 418/133
6,082,986 A 7/2000 Seward et al.
6,422,845 B1 7/2002 Wong et al.
6,481,992 B2 * 11/2002 Wong et al. ..... 418/133

* cited by examiner

*Primary Examiner*—Theresa Trieu
(74) *Attorney, Agent, or Firm*—Brinks Hofer Gilson & Lione

(57) ABSTRACT

A power steering pump for an automotive vehicle comprises a can housing that defines a compartment for receiving a cam plate and a pressure plate. The compartment is sealed by a cover that is threaded into an open end of the canister housing. The cover includes an annular contact that engages the pressure plate to urge the pressure plate against the cam plate. This produces a tight fit that reduces vibration and noise during pump operation. The cover also includes a central recess within the annular pressure plate contact that cooperates with the adjacent pressure plate to form a hydraulic fluid sump.

6 Claims, 2 Drawing Sheets

POWER STEERING PUMP

TECHNICAL FIELD OF THE INVENTION

This invention relates to a power steering pump for an automotive vehicle, and, more particularly, to a cover that includes an annular contact for engaging an adjacent pressure plate and a central recess for creating a hydraulic sump.

BACKGROUND OF THE INVENTION

A power steering system of an automotive vehicle comprises a pump for supplying hydraulic fluid under pressure to a power steering gear assembly. U.S. patent application Ser. No. 10/443,320, filed May 22, 2003, describes a power steering pump that includes a cam plate that defines a cam chamber, and a vaned rotor within the cam chamber for pumping fluid. The cam plate is interposed between pressure plates within a canister housing. The cam plate and the pressure plates are retained by a cover that is secured by a retainer ring. In common practice, the retainer ring is a snap ring that fits in a groove in the inner surface of the can housing. Insertion of the retainer ring is accommodated by clearance between the several elements within the housing. This clearance increases stress on, and wear of, seals between the elements. Also, under the high pressures created during operation, even slight spacing increases noise and vibration.

Therefore, a need exists for a power steering pump wherein the cam plate and the pressure plates are secured within the can housing with reduced clearance, thereby improving sealing and reducing vibration and noise resulting from high pressure operation.

SUMMARY OF THE INVENTION

This invention provides a power steering pump for an automotive vehicle that includes a can housing that defines a compartment having an axis and includes an open end. A cam plate and an upper pressure plate are disposed within the compartment, such that the upper pressure plate is adjacent the open end. A cover is threadingly secured in the open end to enclose the cam plate and the upper pressure plate. The interior side of the cover includes an annular pressure plate contact that engages the upper pressure plate axially opposite the cam plate and a central recess within the annular pressure plate contact that cooperates with the upper pressure plate to define a hydraulic fluid sump that generally axially overlies the cam chamber of the cam plate spaced apart by the upper pressure plate. During manufacture, when the cover is threaded into the open end of the can housing, the annular pressure plate contact is urged against the pressure plate to provide a tight fit between the upper pressure plate and the cam plate, as well as other components within the compartment of the cam housing. This reduces axial clearance between the components within the compartment to enhance sealing and minimize noise and vibration during operation.

BRIEF DESCRIPTION OF THE DRAWINGS

This invention will be further described with reference to the drawings wherein.

DETAILED DESCRIPTION OF THE INVENTION

Figure 1:
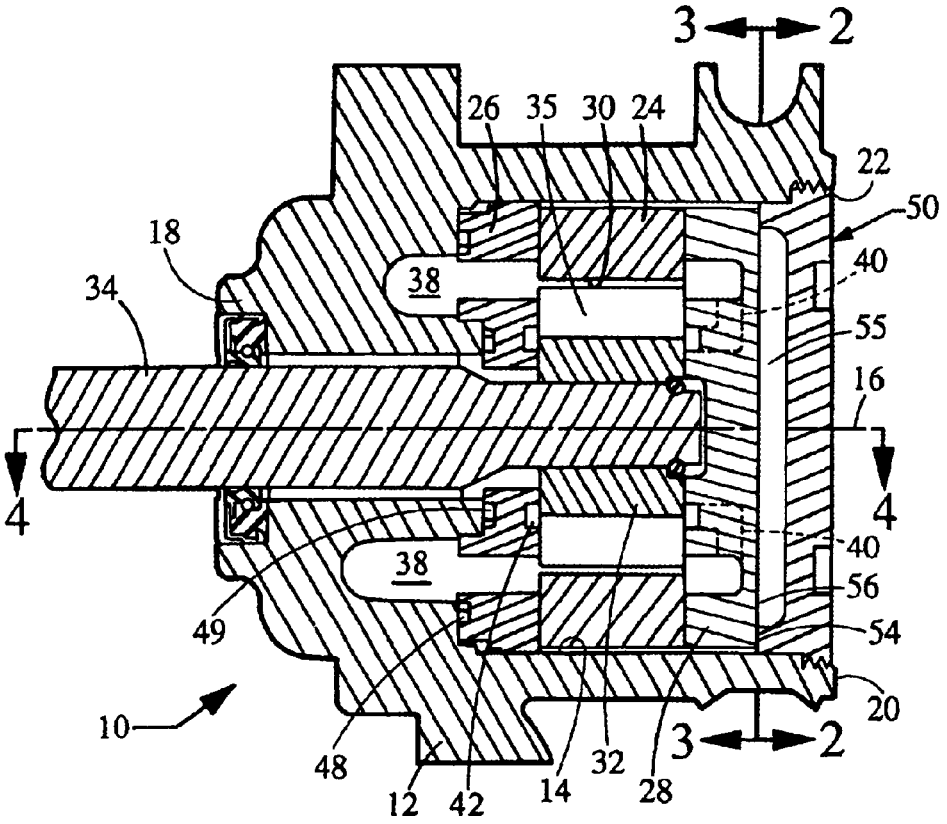
FIG. 1 is a cross-sectional view of a power steering pump in accordance with a preferred embodiment of this invention.
Figure 2:
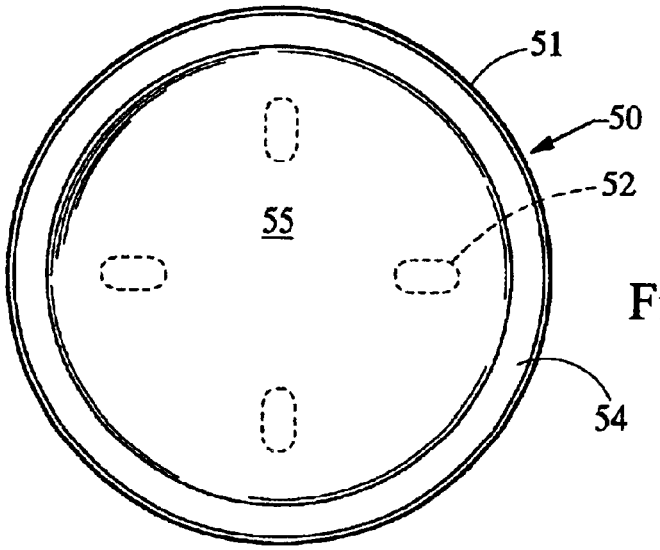
FIG. 2 is a cross-sectional view of the power steering pump in FIG. 1, taken along line 2—2 in the direction of the arrows.
Figure 3:
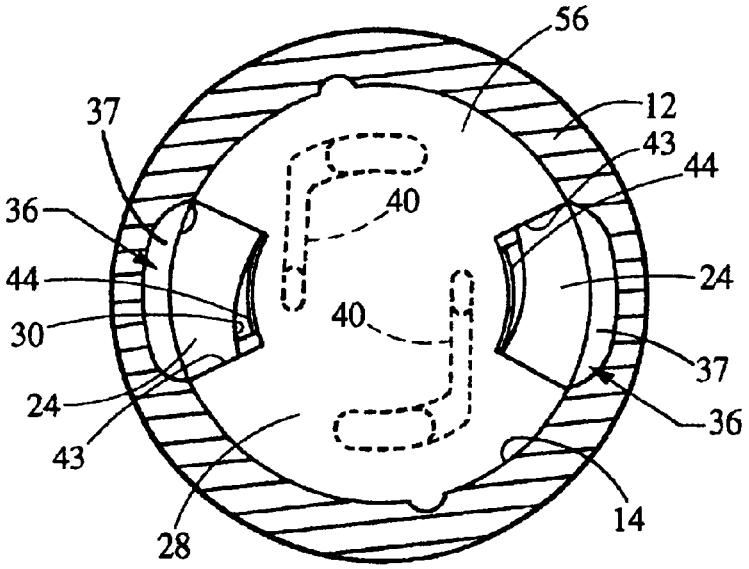
FIG. 3 is a cross-sectional view of the power steering pump in FIG. 1, taken along line 3—3 in the direction of the arrows.
Figure 4:
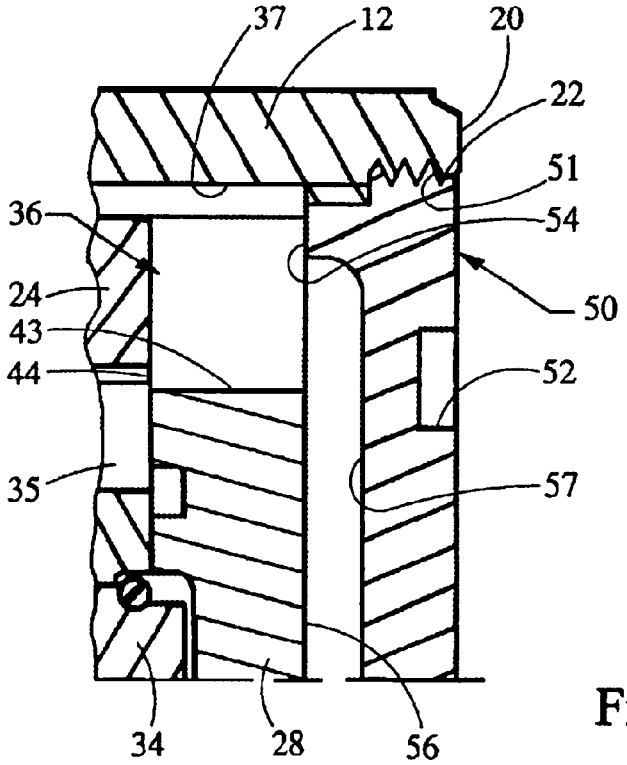
FIG. 4 is a cross-sectional view of a portion of the power steering pump in FIGS. 1 and 2, taken along line 4—4 in FIG. 2 in the direction of the arrows.

In accordance with a preferred embodiment of this invention, referring to the Figs., a power steering pump 10 is adapted for use in a power steering system of an automotive vehicle for providing pressurized fluid to a power steering gear assembly. Pump 10 comprises a can housing 12 that defines a compartment surrounded by an inner wall 14 generally cylindrical about an axis 16. Housing 12 includes a closed end 18 and an open end 20 axially spaced from end 18 and including an inner threaded rim 22.

Received within the compartment perpendicular to axis 16 is a cam plate 24 interposed between a lower pressure plate 26 and an upper pressure plate 28. Cam plate 24 defines a cam chamber 30. A rotor 32 is disposed within cam chamber 30 and mounted on a shaft 34 that extends axially through closed end 18. Shaft 34 is adapted to be driven by a vehicle motor through a belt and pulley arrangement and rotates rotor 32 about axis 16. Rotor 32 includes radially slidable vanes 35 that engage the surface of the cam chamber 30 to pump fluid as rotor 32 is rotated.

The several elements of pump 10 cooperate to define suction passages 36 for conveying relatively low pressure fluid to cam chamber 30 and discharge passages 38 for conveying pressurized fluid from cam chamber 30. It would be appreciated that only a portion of the porting that defines the suction passages and discharge passages are depicted in the figures, and that additional passages are provided for conveying the fluid from the pump inlet and to the pump outlet. In the depicted embodiment, suction passages 36 include axial channels 37 in inner wall 14 of housing 12 and communicate with cutaway slots 43 in upper pressure plate 28 that overlie a portion of the cam chamber 30 to inlets 44 for supplying low pressure hydraulic fluid to the cam chamber. Outlets (not shown) for discharging pressurized fluid from the cam chamber are formed through openings in the lower pressure plate 28. In addition, upper pressure plate 28 includes a conduit 40 that communicates with the cam chamber opposite the outlets for distributing high pressure fluid to undervane porting 42 in rotor 32 for urging the vanes against the surface of the cam chamber. O-ring seals 48 and 49 between low pressure plate 26 and end 18 of can housing 12 separate the suction passages from the discharge passages at closed end 18.

U.S. patent application Ser. No. 10/443,320, filed May 22, 2003, provides further description, particularly with respect to the inlets and outlets to the cam chamber, and the pumping operation of the rotor 32, and is incorporated herein by reference.

In accordance with this invention, housing 12 further comprises a cover 50 for enclosing cam plate 24 and pressure plates 26 and 28 within the compartment in can housing 12. More particularly, cover 50 is mounted within open end 20 of housing 12 and includes outer threads that engage the threaded lip 22. Notches 52 in the outer side of cover 50 are provided for purposes of engaging a tool to screw cover 50 into position. The inner side of cover 50 includes an annular pressure plate contact 54 for engaging the adjacent surface 56 of upper pressure plate 28. In addition, annular contact 54 defines a central recess 57 within cover 50 that cooperates with the adjacent surface of pressure plate 28 to form a hydraulic sump 55. Sump 55 communicates with slots 43 to provide a reservoir for supplying hydraulic fluid to inlets 44 and equalizes pressures between the inlets to provide more uniform pressure in the pumped fluid.

During assembly, cover 50 is threaded into open end 20 to seal the compartment within housing 12 and to secure cam plate 24, lower pressure plate 26 and upper pressure plate 28 in position. Annular contact 54 is strategically located to engage plate 28 axially opposite from cam plate 24 and thereby urge plate 28 into intimate contact with plate 24, and plate 24 into intimate contact with lower pressure plate 26. This produces a tight fit of the several elements within the compartment in marked contrast to the clearance that results with a snap ring to secure the cover. As a result of the tight fit, the stress and wear are reduced thereby extending the durability and useful life of the pump. The tight fit also reduces vibration among the elements that might otherwise lead to damage or produce noise during operation. This is accomplished while providing a sump to enhance distribution of low pressure hydraulic fluid to the inlets to the cam chamber.

In the described embodiment, a single lock cover is utilized to seal and secure the several elements, including the cam plate and the pressure plates, within the pump compartment. The use of a single cover threadingly mounted into the open end of the canister housing reduces the part count, particularly in comparison to a cover and snap ring design, thereby reducing cost and complexity of the pump. In an alternate embodiment, the pump cover may be designed without outer threads to slide into position against the upper pressure plate and secured by a retainer ring threaded into the open end of the canister housing.

While this invention has been described in terms of certain embodiments thereof, it is not intended to be so limited, but rather only to the extent set forth in the claims that follow.

What is claimed is:

1. A power steering pump for an automotive vehicle comprising:

a can housing defining a compartment having an axis and comprising an open end;

an upper pressure plate within the compartment adjacent the open end and including suction passages;

a cam plate within the compartment adjacent the upper pressure plate and surrounding a cam chamber;

a cover threadedly mounted in said open end, said cover comprising an interior side adjacent the upper pressure plate and including an annular pressure plate contact urged against the upper pressure plate axially opposite the cam plate and a central recess within the annular pressure plate contact;

a hydraulic sump defined by the central recess cooperating with the upper pressure plate, the hydraulic sump generally overlying the cam chamber and spaced apart by the upper pressure plate, said sump being in fluid communication with the cam chamber through the suction passages, thereby supplying low pressure hydraulic fluid.

2. The power steering pump of claim 1 wherein the open end of the can section includes inner threads, and said cover comprises outer threads that engage said inner threads.

3. The power steering pump of claim 1 wherein the cover is axially slidably received in the open end and secured by a threaded locking ring in said open end.

4. A power steering pump for an automotive vehicle comprising:

a can housing defining a compartment that is generally cylindrical about an axis and comprising a closed end and an open end opposite said closed end;

a cam plate within the compartment and defining a cam chamber;

a rotor received in the cam chamber and comprising a hub having slots and vanes slidably received in the slots;

an upper pressure plate between the cam plate and the open end, said upper pressure plate comprising an opening overlying a portion of the cam chamber for forming an inlet for supplying hydraulic fluid to the cam chamber; and a cover threadedly mounted in the open end and comprising a generally annular contact surface urged against the upper pressure plate axially opposite the cam plate and a central recess within the generally annular contact surface that cooperates with the upper pressure plate to form a low pressure hydraulic fluid sump in fluid communication with the inlet to the cam chamber.

5. The power steering pump of claim 4, wherein the power steering pump comprises a lower pressure plate between said cam plate and the closed end of said cam housing.

6. The power steering pump of claim 5 wherein the cover urges the upper pressure plate against the cam plate to thereby urge the cam plate against the lower pressure plate to thereby seal the lower pressure plate against the closed end.

* * * * *